US007611306B1

(12) United States Patent
Hallahan et al.

(10) Patent No.: US 7,611,306 B1
(45) Date of Patent: Nov. 3, 2009

(54) LEACHING CHAMBER WITH DRAIN HOLES IN BASE FLANGE

(75) Inventors: Dennis F Hallahan, Old Lyme, CT (US); Ronald P. Brochu, Westbrook, CT (US); James J. Burnes, Deep River, CT (US)

(73) Assignee: Infiltrator Systems, Old Saybrook, CT (US)

( * ) Notice: Subject to any disclaimer, the term of this patent is extended or adjusted under 35 U.S.C. 154(b) by 0 days.

(21) Appl. No.: 11/018,201

(22) Filed: Dec. 20, 2004

Related U.S. Application Data

(63) Continuation-in-part of application No. 10/442,810, filed on May 20, 2003, now Pat. No. 7,351,006.

(51) Int. Cl.
*E02B 11/00* (2006.01)

(52) U.S. Cl. ..... 405/46; 405/49

(58) Field of Classification Search ..... 405/43, 405/44, 45, 46, 47, 48, 49; 210/170, 170.01, 210/170.03, 170.07; D25/16, 17, 18, 20, D25/36; D23/207; D13/155
See application file for complete search history.

(56) References Cited

U.S. PATENT DOCUMENTS

| | | | | | |
|---|---|---|---|---|---|
| 980,442 | A * | 1/1911 | Schlafly | 405/48 |
| 3,054,342 | A * | 9/1962 | McVicar | D25/36 |
| 3,802,133 | A * | 4/1974 | Gregory | D25/18 |
| 4,759,661 | A * | 7/1988 | Nichols et al. | 405/48 |
| 5,087,151 | A * | 2/1992 | DiTullio | 405/43 |
| D329,684 | S * | 9/1992 | Gray | D23/207 |
| 5,419,838 | A * | 5/1995 | DiTullio | 210/170 |
| 5,890,838 | A * | 4/1999 | Moore et al. | 405/49 |
| 6,602,023 | B2 * | 8/2003 | Crescenzi et al. | 405/43 |
| 2002/0044833 | A1 * | 4/2002 | Kruger et al. | 405/43 |

* cited by examiner

*Primary Examiner*—Michael Safavi
(74) *Attorney, Agent, or Firm*—Steven McHugh; Charles Nessler

(57) ABSTRACT

A molded plastic arch shape cross section corrugated leaching chamber has opposing perforated sidewalls running up from feet. Each foot comprises a horizontal flange, an outer-edge fin, and transverse ribs, which define compartments on the flange surface. Drain holes through the flange within each compartment enable water from nearby sidewall perforations to flow downwardly into the soil during use.

8 Claims, 3 Drawing Sheets

LEACHING CHAMBER WITH DRAIN HOLES IN BASE FLANGE

This application is a continuation in part of patent application Ser. No. 10/442,810 of Burnes et al., filed May 20, 2003 now U.S. Pat. No. 7,351,006

TECHNICAL FIELD

The present invention relates to chambers for receiving or dispersing liquids in soil and other granular media, in particular to thermoplastic leaching chambers.

BACKGROUND

Corrugated plastic leaching chambers receive and disperse wastewater when buried within soil and other media. They have been described in various U.S. patents, including U.S. Pat. No. 4,759,661, No. 5,336,017, and No. 5,511,903, all of Nichols et al. and have been widely sold as Infiltrator® chambers. The prior art Infiltrator chambers and chambers from competitors generally have arch shape cross sections with opposing side perforated planar sidewalls running up to the chamber top from bases having flanges to support the chamber on the media within which it is buried.

Recently, improved chambers have been introduced and sold commercially as Infiltrator® Quick4™ chambers. An exemplary chamber is illustrated by FIG. 1 herein. The chambers are described in co-pending U.S. patent applications including Ser. No. 10/677,938 "Corrugated Leaching Chamber" of Brochu et al. and Ser. No. 10/677,772 "Leaching Chamber with Inward Flaring Sidewall Perforations" of Swistak et al. As reference to the products or patent applications will show, the new chambers have various innovative features which include a base flange with a lengthwise fin at the outer edge, along with sidewall slots extending down to the just above the base flange. The chambers are also free of lengthwise or transverse ribs and nest particularly well.

In typical use, the Quick4 chamber is fully surrounded by soil. Wastewater introduced into the chamber interior percolates into the soil at the slot openings. Generally, water discharged from the chamber sidewall flows downwardly to the water table or another discharge point beneath the chamber. However, the micro-physics of how the water moves through the soil in such situations is presently in good measure informed speculation. In part, what happens depends on the character of the soil or other media. In part, the designer of chambers has to respond to the beliefs of sanitary system regulators. The present invention addresses a reasonable hypothesis about how water flows, to give assurance that wastewater percolating into the soil from the chamber is effectively carried away.

SUMMARY

An object of the invention is to provide assurance that there will be good flow away from a chamber sidewall of water passing through all sidewall perforations of a chamber having a base flange, when the chamber has a base flange with an outer-edge fin, while minimally affecting the load bearing function of the flange.

In accord with the invention, a molded plastic arch shape cross section corrugated leaching chamber having opposing side perforated sidewalls which are supported on opposing side feet. The feet comprise a horizontal flange and a vertical fin running along the outermost edge of the flange for strength. Optionally, a multiplicity of spaced apart ribs run across the horizontal flange, to strengthen and in part define a multiplicity of compartments on the flange. The feet have drain holes, preferably vertical holes through the flange, less preferably horizontal holes through the fin, to enable water to drain away, rather than possibly being captured in the compartment. Less preferably, drain holes may instead or in addition be placed in the vertical fin.

In further accord with the invention, when there are compartments, the flow area of drain holes placed in each compartment is equal or greater than the flow area of the perforations of the lowermost portion of the sidewall, which portion a boundary of the compartment. Even when there are not compartments, drain holes are positioned and sized for the local discharge flow area of nearby perforations.

Preferably, when there are a multiplicity of holes through the base flange, the edges of any circular holes are spaced apart from each other by at least one hole diameter; and, the edges of any non-circular holes are spaced apart by a dimension which is at least nominally equivalent to the diameter of a comparable hole.

The invention decreases the barrier to downward flow of water, yet the feet remain strong, for carrying loads.

The foregoing and other objects, features and advantages of the present invention will become more apparent from the following description of preferred embodiments and accompanying drawings.

DESCRIPTION

Figure 1:
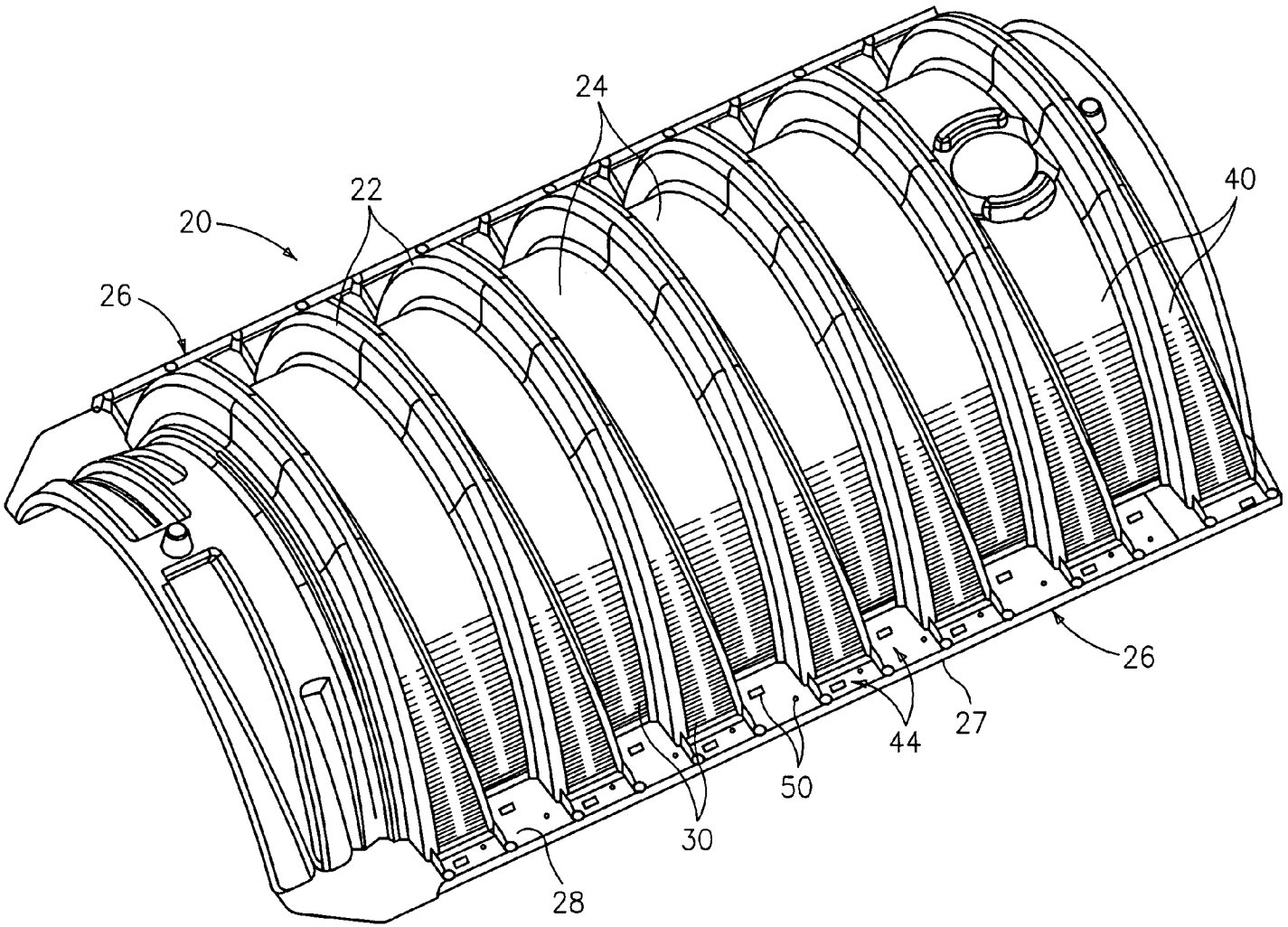
FIG. 1 is an isometric view of a leaching chamber.

FIG. 1 shows an exemplary chamber 20 of the present invention. The descriptions of the above mentioned applications of Brochu et al. and Swistak et al. describe in detail the exemplary chamber. The parent application hereof, Ser. No. 10/442,810, details the features of the dome end which permits swiveling. The disclosures, including the text and drawings, of the foregoing applications are hereby incorporated by reference. Preferably, the chamber is made of injection molded commercial polypropylene, alternately high density polyethylene. The gas-assisted injection molding methodology described in U.S. Pat. No. 5,401,459, and in the references cited therein, is useful.

Chamber 20 has peak corrugations 22 and valley corrugations 24. They run along the continuous, preferably semi-elliptical, curve of the arch shape cross sections. Sidewalls 40 have a multiplicity of slotted openings 30. The opposing sidewalls 40 each run upwardly from feet 26 which run lengthwise. Feet 26 form the base of the chamber, which rests upon soil 38, within which the chamber is buried during use. Each foot 26 is comprised of a horizontal flange 28 having a vertical fin 27 running lengthwise along the outer edge to provide lengthwise rigidity to the foot. Vertical ribs 34 run horizontally along the top surface of flange 28, to connect the opposing side edges of the bottoms of the peak corrugations of the side walls to fin 27. Some drawings show molding knock-out pillars at the intersection of the ribs and fin. The ribs provide lateral bending strength to the flange and strength to the fin, so the chamber can bear vertical load of overlying soil and any vehicle of other thing traversing the surface of the soil. Since the top surfaces of ribs 34 are configured to receive and support the feet of an overlying nested chamber during transport, ribs 34 are often referred to as stacking ribs. Flanges 28 have drain holes 50, discussed below.

Figure 4:
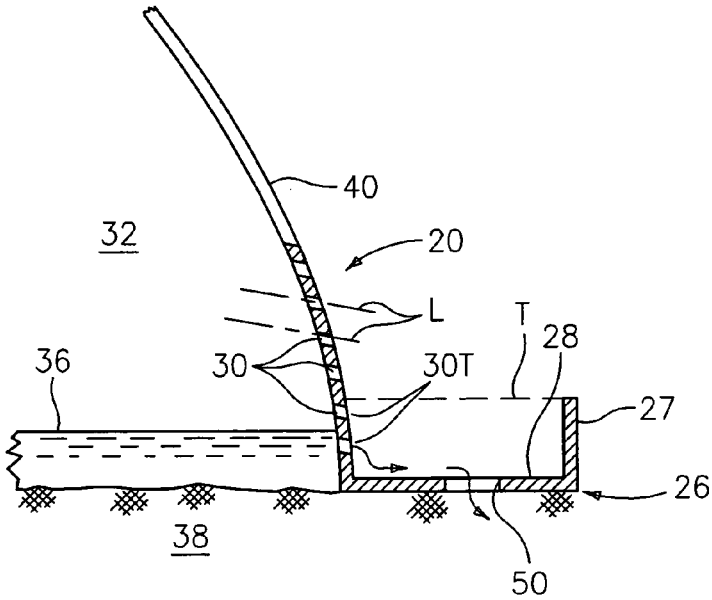
FIG. 4 is a partial end elevation cross section of the chamber buried in soil, showing waster water inside and flowing into the surrounding soil.

During use, wastewater is introduced into the interior 32 of the chamber. In the partial end view cross section of FIG. 4, soil 38 which presses up against the exterior surface of sidewall 40 is omitted for clarity of illustration. Similarly, the ribs 34 are not shown in the Figure. Water introduced into the chamber, typically from a connected chamber or a pipe, will first tend to flow downward through the soil 38 which forms the floor inside the chamber. Depending on rate of inflow to the chamber and permeability of the soil, the water level 36 can rise within the chamber, so that water flows through sidewall slots 30, as indicated by the example of FIG. 4 and the wiggly arrows. It is not unusual that the water level may temporarily rise to the level of a substantial number of slots, even all the slots, of a chamber. As the water level rises, more and more soil surface area will be exposed as water enters ascending slots. In that context, the fractional flow of the lowermost slots 30T, which have exit elevations lower than the elevation plane T of the top of foot fin 27, may be small, compared to the total flow through slots.

Figure 2:
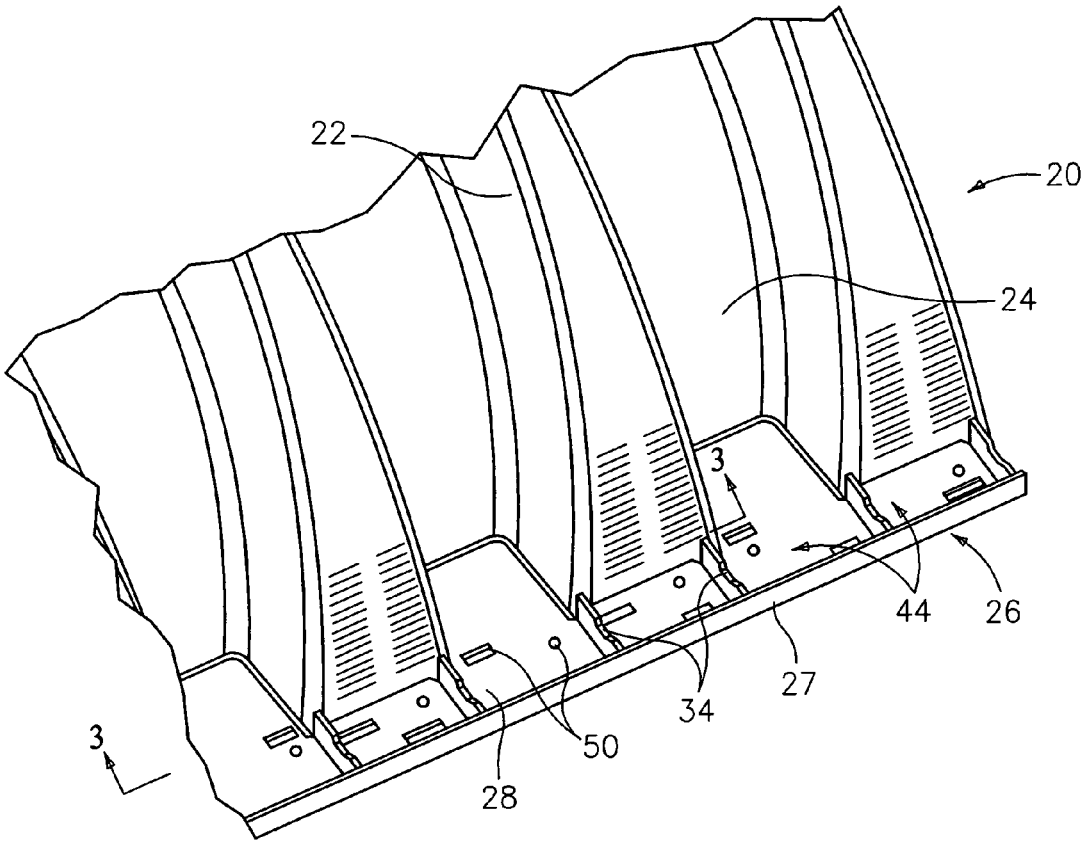
FIG. 2 is an isometric view of the portion of an end of the chamber of FIG. 1 concentrating on the flange drain holes.
Figure 3:
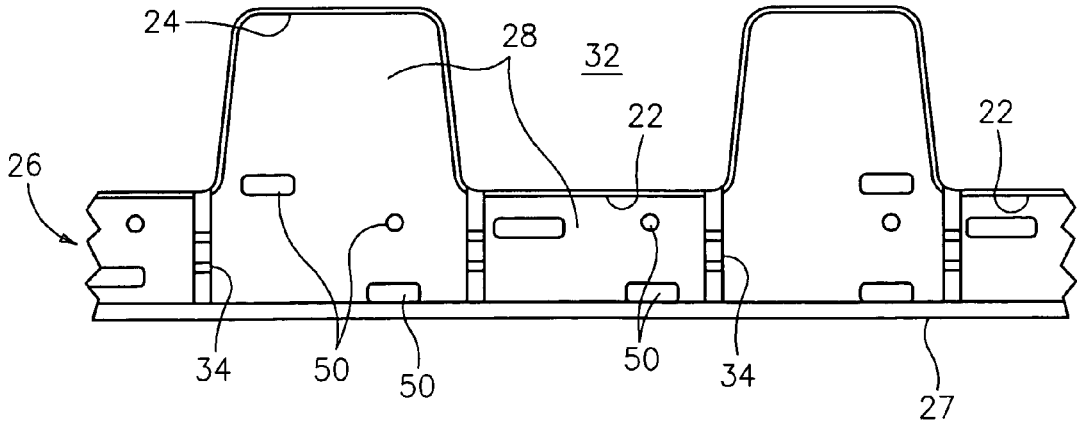
FIG. 3 is a top view through a cross section of the chamber, just above the base flange.

In this embodiment of the invention, flange 28 has drain holes 50. A desirable drain hole array comprising rectangular drain holes and is shown in FIGS. 2 and 3. There are holes with each flange area which forms the bottom of small compartments 44 bounded by ribs 34, the local portion of fin 27 and the local portion of the sidewall. The hypothesis underlying the preferred embodiment is that water from certain nearby slots 30T flow into the compartments 44 and must be carried away. Thus, within any compartment, the total flow area of the drain holes 50 is equal or greater than the flow area of the slots 30T for the particular corrugation, be it peak or valley, which forms an inner bound of the compartment. In one embodiment, the flow area may simply be the opening area at the exterior of the surface of the chamber, for the slots 30T. Alternatively, the flow area of the perforations is calculated based on the soil which reposes at an angle within the perforations. See application Ser. No. 10/677,938 of Brochu et al. and U.S. Pat. No. 5,511,903 of Nichols et al. Thus, water which flows through the chamber sidewall and into the soil-filled compartments can flow downwardly and away, through the soil.

While, it might be conceived that water from slots which are above elevation T can also flow into the compartments, accommodating that is not within the preferred design criteria. It must be kept in mind that the chamber is buried in soil which often offers a lot of resistance to flow of water, and thus it is problematic just how water flows. With the invention, there is assurance that, at least with respect to slots 30T, there is an easy opportunity for water to flow away downwardly.

Figure 5:
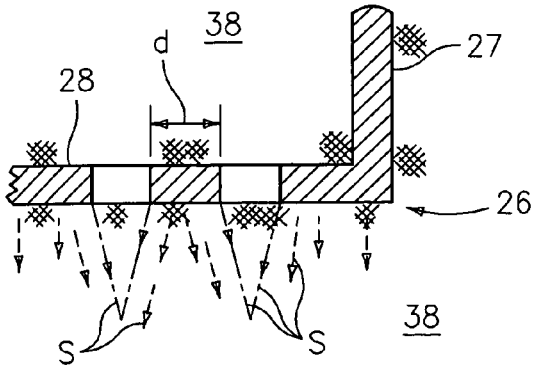
FIG. 5 is a partial end elevation cross section, like 2, showing how the load on a base flange having holes is conceptually distributed in the underlying soil.

For manufacturing reasons, holes are preferably round, although they may be partially or all rectangular as shown. Preferably, there is a plurality of round holes for any compartment. Whatever the shape, holes are preferably spaced apart edge to edge a distance d of at least one largest-hole diameter, as shown in FIG. 5. Preferably the holes are less than 0.5 inch, more preferably between 0.5 and 0.38 inch in diameter. Non-round holes will have nominally equivalent dimension. FIG. 5 illustrates the advantage that obtains when the holes are kept small, within the foregoing range. The weight of soil, vehicles, and other things which is applied to the chamber is resisted by the soil under the fee. The small arrows S suggest how, loosely in accord with soil mechanics, the downward forces are transmitted through the soil. Of course, what happens will depend on the character of the soil, its wetness, etc. However, it should be evident that for any given bottom flange area, smaller holes will provide greater effective soil bearing area to the flange, since the angled lines of force in the soil converge sooner with depth, and since it is harder for soil to extrude upwardly through smaller holes, and for the chamber to sink downwardly as a result.

Figure 6:
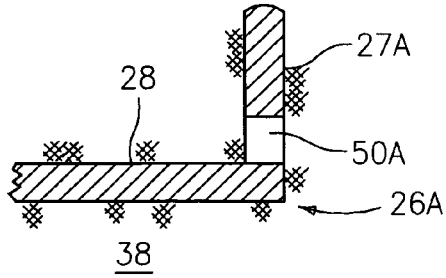
FIG. 6 is like FIG. 5, showing an alternate embodiment flange.

FIG. 6 shows another embodiment of the invention. Foot 26A has perforations or drain holes 50A in the fin 27A. A disadvantage of the FIG. 6 embodiment is it is more difficult to fabricate and the fin is weakened. Holes through the fin may be combined with holes through the flange. Slots or notches, used for lifting a chamber can also serve the purpose of draining of water from the flange. See co-pending patent application of Brochu et al., which was filed on an even date herewith and which was assigned U.S. patent application Ser. No. 11/018,197.

The invention will be useful even if the chamber foot has a fin but does not have ribs, or has ribs widely spaced apart, or has ribs with holes. Drain holes 50 will preferably still be sized with respect to the flow area of the local slot areas of the perforations, as described. At least, the holes will be spaced apart along the length of the foot and will have a total flow area which relates to the total area of slots 30T.

Although this invention has been shown and described with respect to a preferred embodiment, it will be understood by those skilled in this art that various changes in form and detail thereof may be made without departing from the spirit and scope of the claimed invention.

We claim:

1. A molded plastic arch shape cross section corrugated leaching chamber having opposing side perforated sidewalls having perforations for passage of wastewater from the interior of the chamber into the surrounding soil, which comprises:

opposing side feet of the chamber, for supporting the chamber on soil during use, opposing perforated sidewalls, running upwardly from each foot; wherein at least one foot comprises a horizontal base flange;

a vertical fin, running along the outermost edge of the horizontal base flange;

a multiplicity of spaced apart ribs running along the horizontal base flange, to connect an opposing perforated sidewall of the chamber to a respective fin;

wherein the ribs, and local portions of the respective opposing perforated sidewall, fin and flange define at least one compartment on the horizontal base flange with the perforations serving to direct water flow into each respective compartment; and, at least one drain hole through the foot, to enable water flowing into the compartment to flow into soil outside the compartment, wherein the at least one drain hole is configured such that the total flow area of the at least one drain hole is at least equal to the flow area of the perforations which direct water flow into the respective compartment.

2. A molded plastic arch shape cross section corrugated leaching chamber having opposing side perforated sidewalls for passage of wastewater from the interior of the chamber into the surrounding soil, which comprises:

opposing side feet of the chamber, for supporting the chamber on soil during use, opposing perforated sidewalls running upwardly from each foot; wherein at least one foot comprises a horizontal base flange;

a vertical fin, running along the outermost edge of the horizontal base flange;

a multiplicity of spaced apart ribs running along the horizontal base flange, to connect the opposing perforated sidewalls of the chamber to the fin;

wherein the ribs, and local portions of the opposing perforated sidewalls, fin and flange define at least one compartment on the horizontal base flange; and at least one drain hole through the foot, to enable water flowing into the compartment to flow into soil outside the compartment, wherein the flow area of drain holes in the compartment is equal or greater than the flow area of the perforations of the chamber sidewall portion which forms a side of the compartment, which perforations have exits lower in elevation than the plane of the top of the fin.

3. The chamber of claim 2 having a multiplicity of compartments and a multiplicity of spaced apart holes through the horizontal base flange within each compartment.

4. The chamber of claim 2 having a multiplicity of spaced apart holes through the vertical fin which forms a boundary of the compartment.

5. The chamber of claim 2 having a multiplicity of spaced apart holes through the horizontal base flange which forms the base of the compartment.

6. The chamber of claim 2 having a combination of multiplicity of spaced apart holes running through the fin and a multiplicity of spaced apart holes running through the horizontal base flange.

7. The chamber of claim 2 wherein there are a multiplicity of spaced apart holes through the horizontal base flange within the compartment, wherein the edges-of any circular holes are spaced apart from each other by at least one hole diameter, and the edges of any non-circular holes are spaced apart by a dimension which is at least equivalent to the width of the non-circular hole.

8. A molded plastic arch shape cross section corrugated leaching chamber having opposing side perforated sidewalls for passage of wastewater from the interior of the chamber into the surrounding soil, which comprises:

opposing side feet of the chamber, for supporting the chamber on soil during use, opposing perforated sidewalls running upwardly from each foot; wherein at least one foot comprises a horizontal base flange;

a vertical fin, running along the outermost edge of the horizontal base flange;

a multiplicity of spaced apart ribs running along the horizontal base flange, to connect the opposing perforated sidewalls of the chamber to the fin;

wherein the ribs, and local portions of the opposing perforated sidewalls, fin and flange define at least one compartment on the horizontal base flange; and at least one drain hole through the foot, to enable water flowing into the compartment to flow into soil outside the compartment, wherein the at least one compartment and the at least one drain hole includes having a multiplicity of compartments and a multiplicity of spaced apart holes through the horizontal base flange within each compartment wherein the flow area of the multiplicity of drain holes in each compartment is equal or greater than the flow area of the perforations of the chamber sidewall portion which forms a side of the compartment, which perforations have exits lower in elevation than the plane of the top of the fin.

* * * * *